US006109713A

United States Patent [19]

Geserich et al.

[11] Patent Number: 6,109,713

[45] **Date of Patent: *Aug. 29, 2000**

[54] CONFIGURATION FOR PRINTING STRIPLIKE PRINT CARRIERS

[75] Inventors: Frank Geserich; Wolfgang Von Inten, both of Berlin, Germany

[73] Assignee: Francotyp-Postalia AG & Co., Birkenwerder, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,600

[22] Filed: Mar. 11, 1998

[30] Foreign Application Priority Data

Mar. 11, 1997 [DE] Germany ..... 197 12 077

[51] Int. Cl.[7] ..... B41J 3/00

[52] U.S. Cl. ..... 347/4

[58] Field of Search ..... 347/4, 37, 2, 44; 101/91

[56] References Cited

U.S. PATENT DOCUMENTS 5,813,326 8/1998 Salomon ..... 101/93
5,880,747 3/1999 Bartenwerfer et al. ..... 347/4

FOREIGN PATENT DOCUMENTS 196 05 015
C1 3/1997 Germany .

*Primary Examiner*—William Royer
*Assistant Examiner*—Greg Moldafsky
*Attorney, Agent, or Firm*—Herbert L. Lerner; Laurence A. Greenberg; Werner H. Stemer

[57] ABSTRACT

A configuration for printing striplike print carriers in a postage meter and/or addressing machine, includes contact-pressure elements secured to a revolving conveyor belt for transporting the print carriers upright and in contact with a guide plate having a printing window. The contact-pressure elements are movable resiliently toward and away from the guide plate and the print carriers are printed by an ink jet print head located behind the printing window. In order to expand a range of use, increase reliability and make it possible to selectively print not only letters but also postage strips or address labels, a strip magazine in an entrance region of the otherwise conventional print carriers, a guide part which is disposed in an insert and is initially concave and then convex in shape, and a spacer part in the printing window, which is adapted to a jet distribution, are disposed at the level of the printing window. The strips are therefore guided essentially centrally along the printing window and above the conveyor belt by the contact-pressure elements, to assure uniform utilization of a printing field of the strips and prevent information losses.

6 Claims, 3 Drawing Sheets

CONFIGURATION FOR PRINTING STRIPLIKE PRINT CARRIERS

BACKGROUND OF THE INVENTION

Field of the Invention

The invention relates to a configuration for printing striplike print carriers in a postage meter and/or addressing machine.

Printing in postage meters was heretofore primarily carried out through the use of ink rollers or thermal print heads. Recently, attempts are being made to extend the advantages of ink jet printing to the postage meter field as well.

The printing is carried out in a contactless manner through the use of ink jet print heads, as is seen in German Patent DE 44 24 771 C1 and German Utility Model DE 94 20 734 U1.

In that connection, a postage meter and/or addressing machine has been proposed in German Patents DE 196 05 015 C1 and DE 196 45 363 C1, which correspond to U.S. application Ser. No. 08/791,629, filed Jan. 31, 1997, in which the print carriers, referred to below as letters (which includes envelopes) are advanced upright, tilting slightly to the rear, with the aid of contact-pressure elements that are secured to a revolving conveyor belt. The letters rest on a guide plate in which a printing window is provided and in which the ink jet print head is permanently installed. The printing window is mounted at a level above the conveying plane of the conveyor belt in which the imprint is to be made on the letter. The contact-pressure elements are disposed in such a way that they can move resiliently toward and away from the guide plate. The letters are engaged through the use of the contact-pressure elements in a force-locking manner, on their side remote from the guide plate, during the process of conveying and printing. A force-locking connection is one which connects two elements together by force external to the elements, as opposed to a form-locking connection which is provided by the shapes of the elements themselves.

The guide plate, which is constructed as a smooth, flat plate, is provided with slide rails and has an insert with molded-in slide rails and with a printing window. The insert is made of a nonrusting metal.

The individual contact-pressure element is constructed as a resiliently supported bracket with a contact-pressure plate, having an outside which is partially coated with a friction lining. The contact-pressure plate is formed of plastic, preferably a polyamide. The friction lining is preferably made of polyurethane. The contact-pressure plate is partially provided with the friction lining on its end surface in such a way that it can only come to rest in a force-locking manner on a letter. If there is no letter present, the contact-pressure plate slides with the unoccupied smooth part along a slide rail, and the friction lining is located in the open. Accordingly, the friction lining is thinner than a distance by which the slide rail protrudes from the base.

The printing window for postage meter printing is mounted at such a distance from the conveying plane of the conveyor belt that a lower edge of the postage imprint maintains a spacing of 40 mm from an adjacent edge of the letter, which is specified by postal regulations.

If an address is also to be printed, then the associated printing window is correspondingly higher.

In order to provide a prescribed franking imprint width of one inch, or 25.4 mm, an upper edge of the postage imprint must accordingly be spaced apart from an adjacent edge of the letter by around 14 mm.

At least with bulky mail there is a need for attaching postage and addresses through the use of self-adhesive strips. Accordingly, instead of a letter, a strip for imprinting has to be placed in the postage meter. A typical standard width for the postage meter strips is 44 mm. If that kind of "narrow" postage strip is then imprinted in that postage meter, then the postage imprint must have a spacing of 14.6 mm from one edge of the strip and a spacing of 4 mm from the other edge of the strip, because of the above-described fixed spacings. Since those postage strips as a rule are disposed as self-adhesive strips on a correspondingly wider backing strip, there is a danger that the smaller spacing can become so slight that the postage imprint will no longer fit entirely on the postage meter strip.

Given the above-mentioned situation, printing an address on narrow strips through the associated printing window would not be possible at all.

SUMMARY OF THE INVENTION

It is accordingly an object of the invention to provide a configuration for printing striplike print carriers, which overcomes the hereinafore-mentioned disadvantages of the heretofore-known devices of this general type, which expands a range of use and increases reliability and with which not only letters but also so-called "narrow" postage meter strips or address strips can be selectively printed.

With the foregoing and other objects in view there is provided, in accordance with the invention, a configuration for printing striplike print carriers in a postage meter and/or addressing machine, comprising a guide plate defining an entrance region and an arrival region of otherwise conventional striplike print carriers having a maximum allowable thickness and a shortest length, the guide plate having a printing window and having a recess formed therein in the arrival region, and the guide plate having an insert with a guide plane, the recess opening ahead of the guide plane of the insert; a revolving conveyor belt having contact-pressure elements secured thereto for transporting the print carriers upright in contact with the guide plate in a transport direction along a conveying plane, adjacent contact-pressure elements mutually spaced apart by a spacing less than the shortest length; an ink jet print head disposed behind the printing window for printing the print carriers, the ink jet print head defining a jet distribution in a jet plane and jet-free surfaces; a strip magazine disposed in the entrance region transversely to and at a spacing from the guide plate greater than the maximum allowable thickness, the strip magazine having an exit opening for dispensing the print carriers obliquely to the transport direction and above the conveying plane toward the guide plate; a guide part inserted in the recess for guiding the print carriers, the guide part having an initially concave and finally convex shape, an exit region, and two guide tabs on the insert vertically bordering the exit region; a spacer part disposed in the vicinity of the printing window and adapted to the jet distribution for covering the jet-free surfaces; and the exit opening having a middle, the guide part having a middle, and the printing window having a middle all located at approximately the same level.

In accordance with another feature of the invention, the exit opening of the strip magazine has an adjustable gap width and a directional preorientation, and the strip magazine has an openly accessible refill opening and an independent strip expeller.

In accordance with a further feature of the invention, the guide part has a depression with vertically defined straight stop surfaces and an end with a convex protrusion.

In accordance with an added feature of the invention, the ink jet print head has rows of jets defining regions between the rows, and the spacer part has prongs protruding into the regions.

In accordance with an additional feature of the invention, the strip magazine has an exit region, and the strip expeller is disposed at the exit region and includes a drive motor having a step-down gear and a motor shaft, a cap-shaped flange secured to the motor shaft, and a drive roller driven by the motor, seated on the cap-shaped flange and surrounding the motor jointly with the cap-shaped flange.

In accordance with a concomitant feature of the invention, there is provided an adjustable, lockable adjusting baffle for adjusting the gap width of the exit opening, the baffle having an outer edge parallel to and adjacent the drive roller, and guide parts curved in the exit region for preorienting the strips.

The structure according to the invention of the strip magazine, of the guide part for the strips, and of the associated part of the insert in the guide plate, as well as of the printing window with the spacer part, has several advantageous and sometimes even synergistic effects.

The disposition according to the invention of the strip magazine in the entrance region of the otherwise conventional print carriers transversely to the guide plate and at a distance therefrom that is equivalent to the thickest allowable letter, makes it possible without restrictions to handle letters under the previous conditions as well as to print postage strips and address labels with only one stationary ink jet print head.

The structure of the strip magazine with a refill opening that is freely accessible toward the user, an exit opening that can be adapted to the thickness of the strip, and a directional preorientation of the strips inside the magazine through the use of a suitably curved structure of the exit region, has several advantages. For instance, strips can be reloaded without having to interrupt a printing operation.

The emergence of two strips at a time is effectively prevented through the use of the precisely adjusted exit opening.

Each strip is preoriented in the transport direction and is dispensed above the conveying plane of the conveyor belt.

The recess in the insert of the guide plate with the inserted, initially concave and then convexly shaped guide part and with the two guide tabs assures both correctly positioned guidance of the strip to the engagement region of the contact-pressure elements and a deformation back into the straight, elongated shape.

The adaptation of the contact-pressure element spacings to the strip length assures that one strip will always be grasped. Transport with only one spacer element is possible with strips of relatively great stiffness. Since the spacer elements are detachably secured to the conveyor belt, a suitable adaptation can easily be carried out by servicing personnel.

The spacer part, which is adapted to the level of the jets of the ink jet print head in the region of the printing window, on one hand enables a small spacing between the print carriers and the ink jet print head and on the other hand prevents a contact between them. This avoids smearing of the jet surface and of the printed image.

Since the middle of the exit opening of the strip magazine, the middle of the guide part and the middle of the printing window are disposed at the same level, a uniform utilization of the printing field of the strips is assured, and information losses are averted.

Other features which are considered as characteristic for the invention are set forth in the appended claims.

Although the invention is illustrated and described herein as embodied in a configuration for printing striplike print carriers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
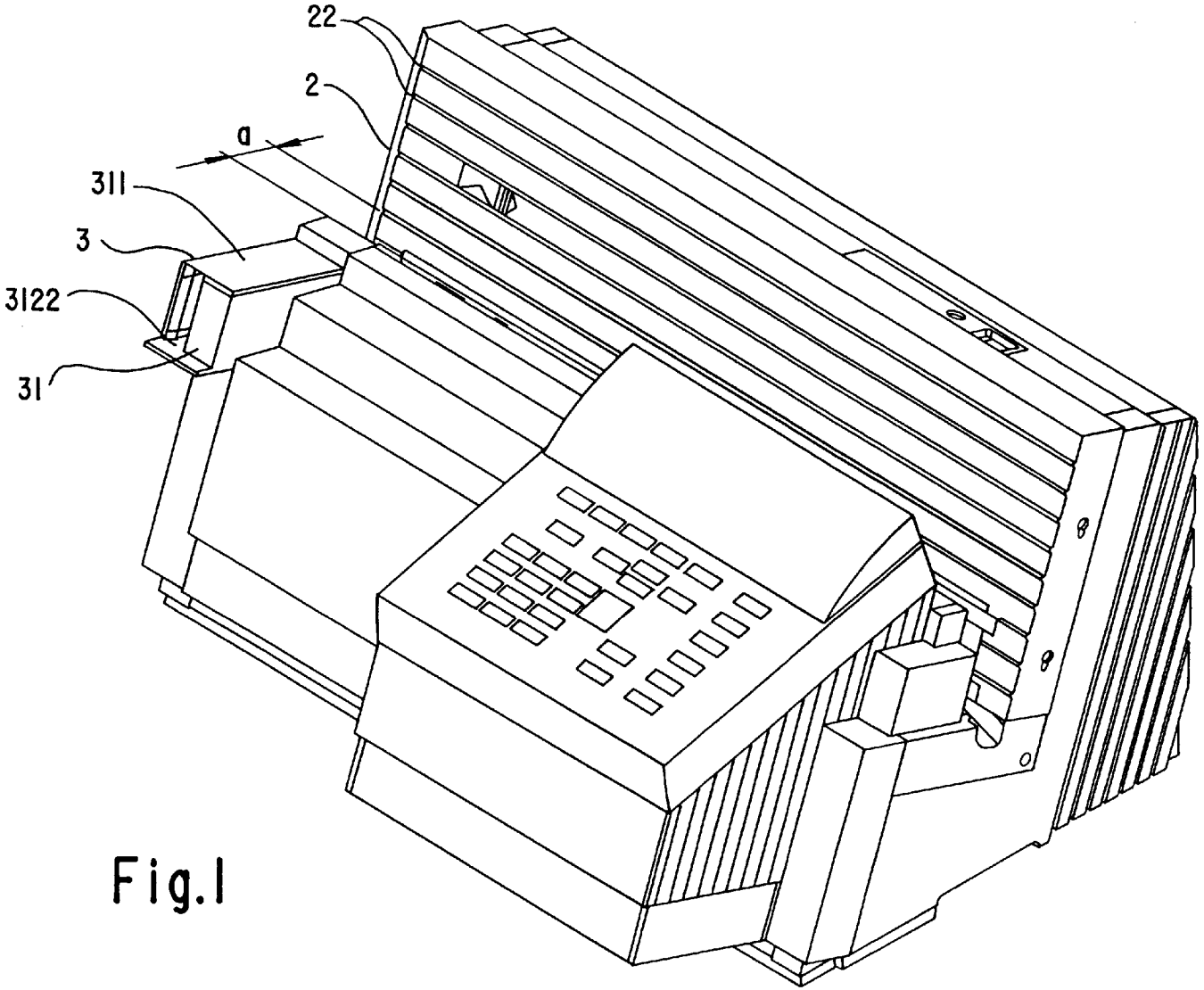
FIG. 1 is a diagrammatic, right-front perspective view of a postage meter with the configuration according to the invention.

Referring now in detail to the figures of the drawings, in which the illustrations are partly diagrammatic for the sake of simplification and easier comprehension, and first, particularly, to FIG. 1 thereof, there is seen a strip magazine 3 with a built-in drive for strip expulsion disposed in an entrance region of otherwise typical print carriers, referred to below as letters, transversely to their transport direction.

The strip magazine 3 is spaced from a guide plate 2 with slide rails 22 for the letters by a spacing a, which is greater than a maximum allowable thickness of the letters. The strip magazine 3 has a housing 31 and a cap 311 adapted thereto.

Strips can be reloaded through a refill opening 3122, even during operation.

Figure 2:
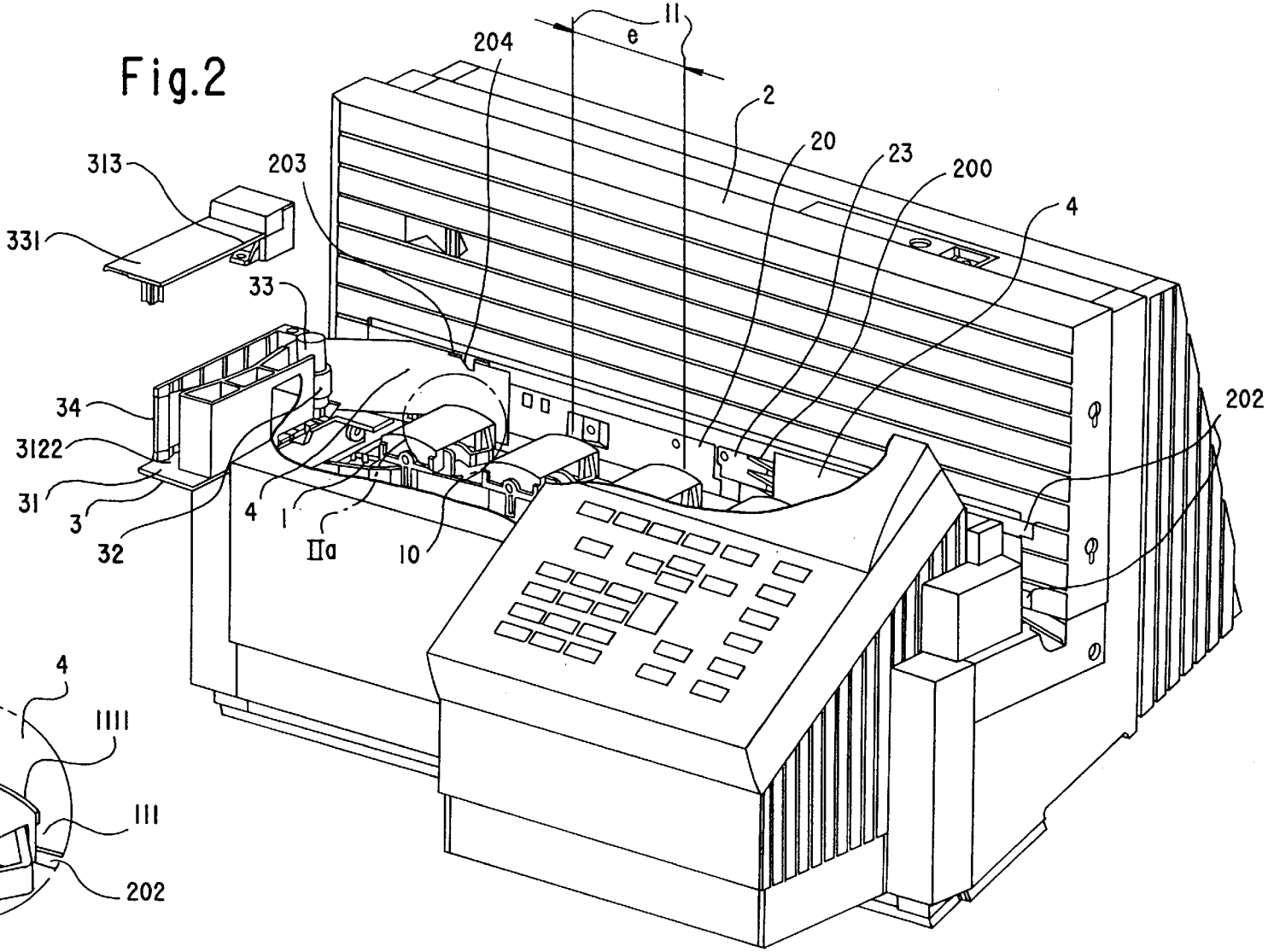
FIG. 2 is a partly exploded, right-front perspective view of the configuration of FIG. 1.
Figure 2A:
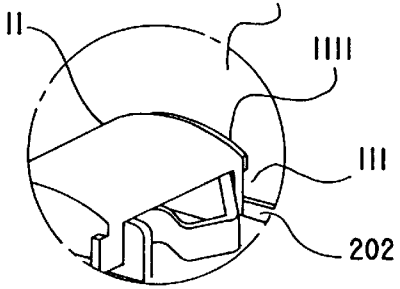
FIG. 2*a* is an enlarged perspective view of a portion IIa of FIG. 2.
Figure 3B:
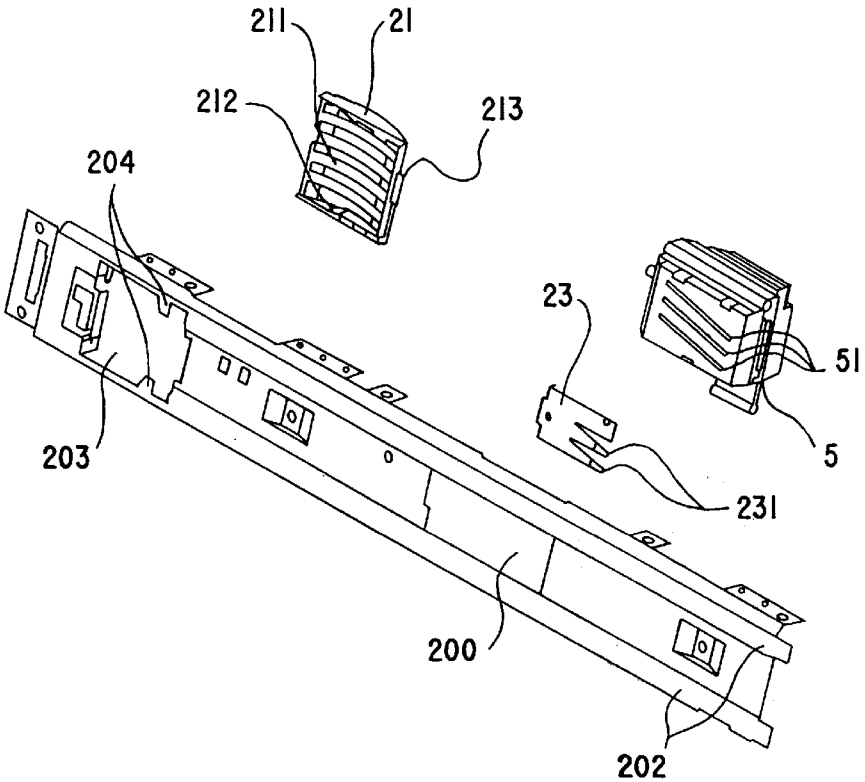
FIG. 3*b* is an exploded perspective view of an insert in a guide plate.

As is shown in FIGS. 2, 2*a* and 3*b*, the configuration of the invention includes:

- a revolving conveyor belt 1 with contact-pressure elements 11; the strip magazine 3 for strip-shaped print carriers or strips 4 with a drive for strip expulsion;
- a recess 203 with guide tabs 204 in an insert 20 of the guide plate 2 ahead of an arrival region of the contact-pressure elements 11; the insert 20 having a guide plane 202
- a concave and then convexly shaped guide part 21, which is inserted into the recess 203; and
- a spacer part 23, which is provided with prongs 231 that protrude in the transport direction into a printing window 200 in regions between rows 51 of jets and keep the print carrier 4 spaced apart from a jet surface of an ink jet print head 5.

All of the parts that determine the guidance are disposed in terms of height in such a way that the strip 4 meets the printing window 200 approximately centrally.

Figure 3A:
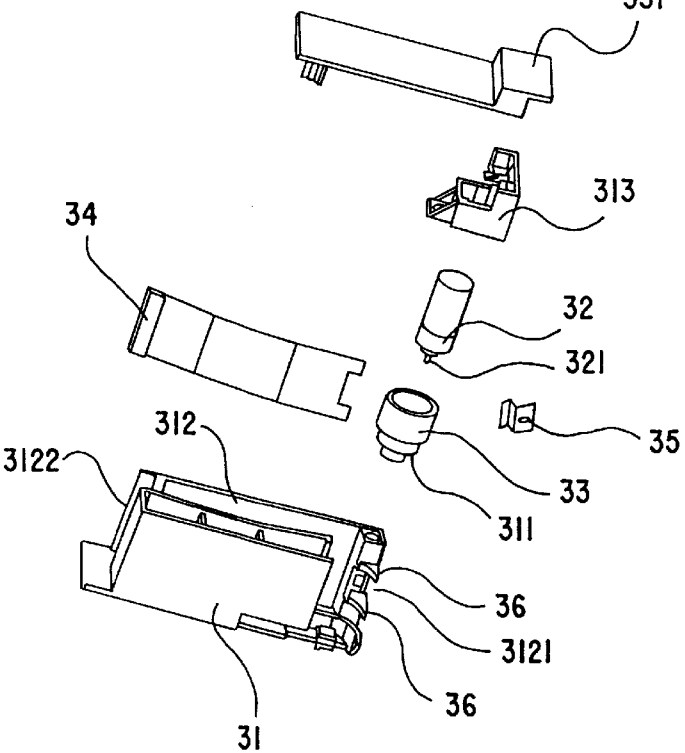
FIG. 3*a* is an exploded perspective view of a strip magazine.

Referring to FIGS. 2 and 3*a*, it is noted that the strip 4 passes through an exit opening 3121 adapted to the strip thickness, above a conveying plane 10 of the conveyor belt 1 to reach the guide plate 2. In other words, the strip 4 does not touch the conveyor belt 1 and accordingly does not stand on it either. The strip 4 is guided inside the strip magazine 3 in such a way that it is dispensed obliquely to the transport direction.

With reference to FIG. 3*b*, it is noted that at the guide plate 2, the strip 4 strikes a depression 211 of the guide part 21 and is deflected by it, and guided in terms of height, by straight stop surfaces 212 between two guide tabs 204 through a convex protrusion 213 into the transport direction of the conveyor belt 1. Due to the change from the concave to the convex shape, any curvature in the strip 4 that might have previously been imposed is straightened out.

Upon leaving the guide part 21, the beginning of the strip 4 is engaged at its lower edge by a contact-pressure element 11, that is by a friction lining 1111 with which a contact-pressure plate 111 of the contact-pressure element 11 is partially coated. A spacing e between adjacent contact-pressure elements 11 is selected in such a way that even a strip 4 having the shortest length 1 will still be engaged by two contact-pressure elements 11.

The contact-pressure elements 11 are continuously released in a letter entrance region through the use of a non-illustrated slot guide, directly downstream of the recess 203, so that each print carrier located in that region will be grasped in a force-locking manner.

A distance from the exit opening 3121 to the region in which the strip 4 is engaged in a force-locking manner is selected in such a way that the strip 4 will also be released by the strip expulsion device as well.

The strip 4 engaged by the contact-pressure elements 11 is moved, while resting on the insert 20, past the printing window 200 and is printed through the use of the ink jet print head 5 seen in FIG. 3*b*.

In this case, an ink jet print head 5 which is assembled from three modules by the so-called non-interlaced principle is used. The three rows 51 of jets extend obliquely and are spaced apart from one another.

The suitably shaped spacer part 23 is disposed in the region of the printing window 200 in such a way that on one hand the print carrier 4 moves past the ink jet print head 5 sufficiently close enough to ensure that all of the jets can print freely, but on the other hand that contact between the print carrier 4 and the jet surface of the ink jet print head 5 is prevented. In that case, the spacer part 23 protrudes with its prongs 231 into gaps between the rows 51 of jets of the ink jet print head 5. In order to assure defined spacings between the spacer part 23 and the jet surface of the ink jet print head 5, the spacer part 23 and the ink jet print head 5 are secured to a common support, in a non-illustrated manner.

The strip magazine 3 is constructed with a compact structure. Its dimensions in terms of length and height are determined substantially by the dimensions of the largest strips 4 that will be used.

The housing 31 of the strip magazine 3 includes the aforementioned cap 311 and a tub 312 which is seen in FIG. 3*a*. The exit opening 3121 and the refill opening 3122 are contained in end walls of the tub 312. Two inwardly-curved guide parts 36, which determine the exit direction of the strips 4, are formed into the end wall for the exit opening 3121. A contact-pressure spring 34 for the strips 4, which is constructed as a leaf spring, is inserted at one end into a corresponding slot in a side wall of the tub 312. Another end is adapted to a contour of a drive roller 33 for the strips 4 in such a way that contact between the contact-pressure spring 34 and the drive roller 33 is avoided. The thus unlatched end of the contact-pressure spring 34 rests on one strip 4 when the strip magazine 3 is full. If the strip magazine 3 is empty, the end rests on a curved inner wall of the tub 312. The curvature makes strip replenishment easier.

The drive roller 33 is seated on a cap-shaped flange 331, which in turn is secured to a shaft 321 of a motor 32 with a step-down gear. The cap-shaped flange 331 is dimensioned in such a way that it is fitted over the motor 32 in a cuff-like manner. This keeps the structural height of the strip magazine 3 low. The motor 32 together with the flange 331 and the drive roller 33 is secured to a retaining angle bracket 313, which in turn is secured to the bottom of the tub 312. Therefore, the strip magazine 3 has a strip expeller in an exit region which includes the motor 32 and the drive roller 33.

An adjusting baffle 35 for the exit opening 3121 is secured detachably to the associated end wall of the tub 312 through the use of a screw connection. The adjusting baffle 35 is constructed as a bent angle part with an oblong slot. A gap width of the exit opening 3121 is determined by a spacing between a front edge of the adjusting baffle 35 and the drive roller 33. The adjustment can be carried out simply, by placing a strip 4 that is intended to be used between the drive roller 33 and the front edge of the adjusting baffle 35 and thrusting the adjusting baffle within the oblong slot until it nearly comes to a stop on the strip 4 and then arresting it there.

We claim:

1. A configuration for printing striplike print carriers in a postage meter and/or addressing machine, comprising:

a guide plate defining an entrance region and an arrival region of otherwise conventional striplike print carriers having a maximum allowable thickness and a shortest length, said guide plate having a printing window and a recess formed in said arrival region, and said guide plate having an insert with a guide plane wherein said recess opening is ahead of said guide plane in the transport direction;

an ink jet print head disposed behind said printing window for printing the print carriers, a strip magazine disposed in said entrance region transversely to and at a spacing from said guide plate greater than the maximum allowable thickness, said strip magazine having an exit opening for dispensing the print carriers obliquely to the transport direction and above said conveying plane toward said guide plate;

2. The configuration according to claim 1, wherein said exit opening of said strip magazine has an adjustable gap width and a directional preorientation, and said strip magazine has an openly accessible refill opening and an independent strip expeller.

3. The configuration according to claim 1, wherein said guide part has a depression with a top and a bottom formed into straight stop surfaces and an end with a convex protrusion.

4. The configuration according to claim 1, wherein said ink jet print head has rows of jets defining regions between said rows, and said spacer part has prongs protruding into said regions.

5. The configuration according to claim 2, wherein said strip magazine has an exit region, and said strip expeller is disposed at said exit region and includes a drive motor having a step-down gear and a motor shaft, a cap-shaped flange secured to said motor shaft, and a drive roller driven by said motor, said drive roller seated on said cap-shaped flange and surrounding said motor jointly with said cap-shaped flange.

6. The configuration according to claim 5, including an adjustable, lockable adjusting baffle for adjusting the gap width of said exit opening, said baffle having an outer edge parallel to and adjacent said drive roller, and guide parts curved in said exit region for preorienting the strips.

* * * * *